US006564523B1

(12) United States Patent
Iole et al.

(10) Patent No.: US 6,564,523 B1
(45) Date of Patent: May 20, 2003

(54) ROOFING FOR BUILDINGS, WITH SYNTHETIC RESIN MOLDED COMPONENTS

(76) Inventors: Baldini Iole, via Zanobi da Strada 37, 50012 Ponte a Ema, Bagno a Ripoli, Firenze (IT); Mazzoli Mariagrazia, via di Ripoli 188, 50126 Firenze (IT)

( * ) Notice: Subject to any disclaimer, the term of this patent is extended or adjusted under 35 U.S.C. 154(b) by 0 days.

(21) Appl. No.: 09/601,991

(22) PCT Filed: Feb. 8, 1999

(86) PCT No.: PCT/IT99/00027

§ 371 (c)(1),
(2), (4) Date: Aug. 9, 2000

(87) PCT Pub. No.: WO99/41469

PCT Pub. Date: Aug. 19, 1999

(30) Foreign Application Priority Data

Feb. 10, 1998 (IT) ..... FI98A0030

(51) Int. Cl.[7] ..... E04D 1/20

(52) U.S. Cl. ..... 52/521; 52/533; 52/536; 52/542

(58) Field of Search ..... 52/521, 533, 536, 52/542

(56) References Cited

U.S. PATENT DOCUMENTS

| | | | | |
|---|---|---|---|---|
| 2,362,236 A | | 11/1944 | Bassler | |
| 3,783,570 A | * | 1/1974 | Storch | 52/536 |
| 4,084,365 A | | 4/1978 | Read | |
| 5,615,523 A | * | 4/1997 | Wells et al. | 52/520 |

FOREIGN PATENT DOCUMENTS

| | | |
|---|---|---|
| CA | 1328725 | 4/1994 |
| DE | 1 926 870 | 7/1965 |
| DE | 86 33 099.3 | 4/1987 |
| EP | 0 020 103 A2 | 12/1980 |
| EP | 0 550 800 A2 | 7/1993 |
| FR | 1 386 138 | 12/1964 |
| FR | 1 458 560 | 11/1966 |
| WO | WO 94/09223 | 4/1994 |

* cited by examiner

*Primary Examiner*—Michael Safavi
(74) *Attorney, Agent, or Firm*—McGlew and Tuttle, P.C.

(57) ABSTRACT

A tile made of stiff molded synthetic resin having edges which overlap when a plurality of tiles are assembled upon a roof and an upper continuous contoured ridge along the upper edge and a lower continuous contoured ridge along the lower edge. The upper and lower ridges being stepped shape to engage with horizontal continuity when a plurality of tiles are assembled upon a roof. A through hole is provided in the lower ridge which aligns with a slot in the upper ridge to allow a screw to pass therethrough fastening two contiguous rows of tiles to a supporting structure.

13 Claims, 8 Drawing Sheets

V
1
13
5E
5B
5
3A
24
XI
5E
3E
24
XI
3C
3F
3E1
f1
VIII
X
IX
3E
1
VII
VII
26
30
11
3B
VI
VIII
VI
IX
V
X 13
5E
5B
5
3A
5B
5E
1
24
24
9
3E1
3F
f1
3H
3E
3G
30
30
3C
15
26
26A
11

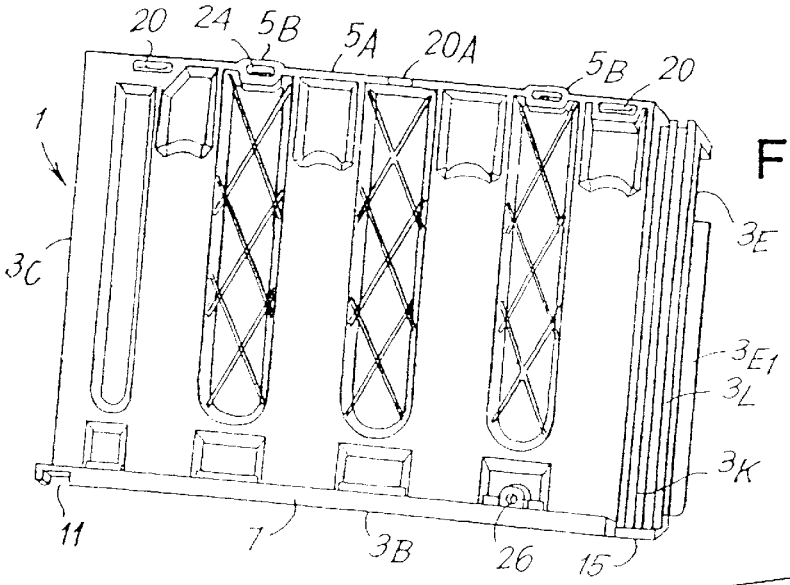
Fig.4
Fig.5
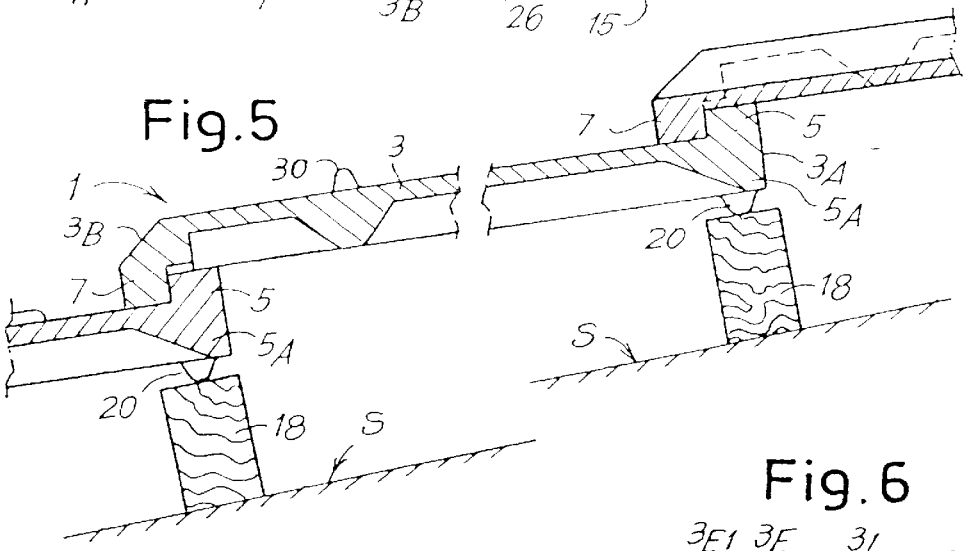
Fig.6
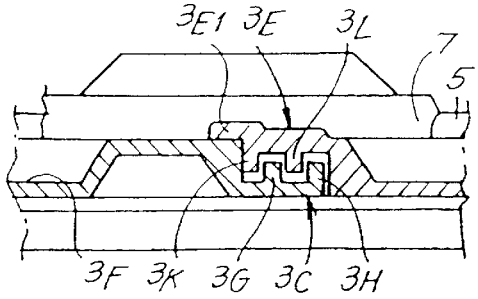
Fig.7
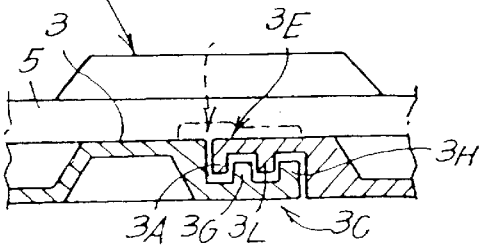

Fig.8
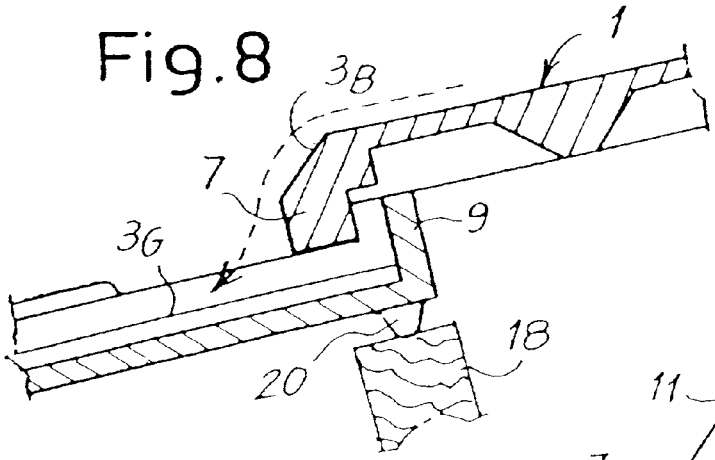
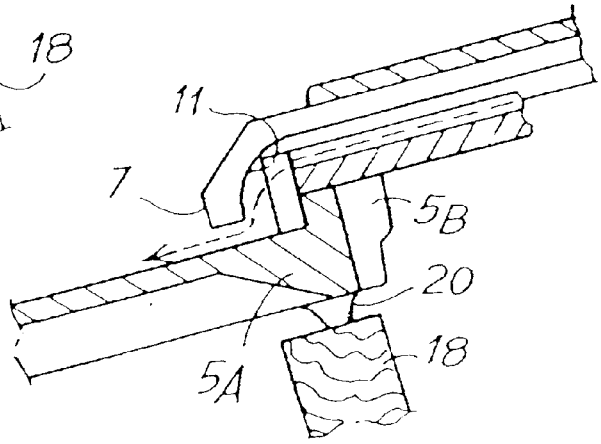
Fig.9
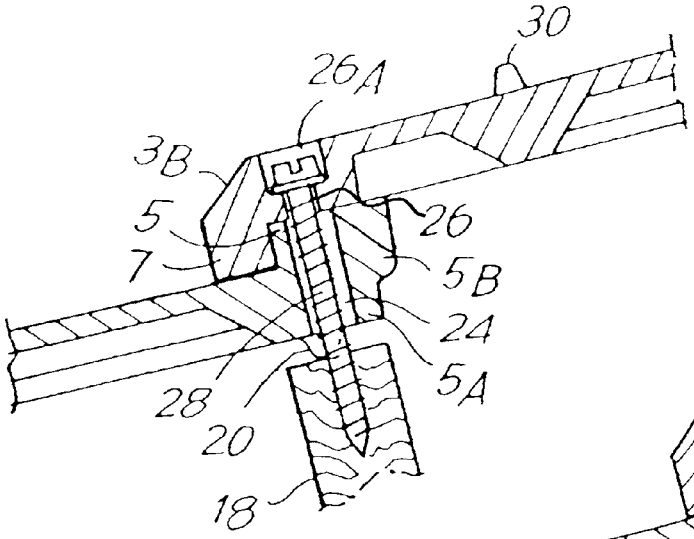
Fig.10
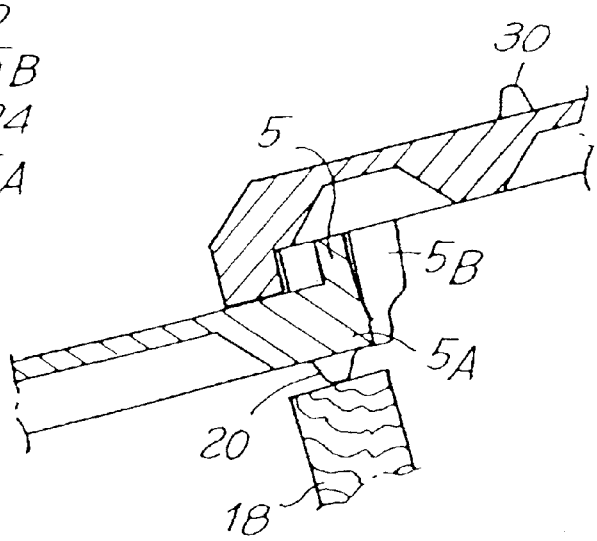
Fig. 11

ROOFING FOR BUILDINGS, WITH SYNTHETIC RESIN MOLDED COMPONENTS

FIELD OF THE INVENTION

The invention relates to a roofing, for flat or arched roofs, made with molded synthetic-resin components shaped so as to permit rapid and stable assembly, effective protection from the infiltration of rain water, thermal and acoustic insulation and other purposes and advantages, which will be clear from the following text. It is also important to note that—among other things—the covering hereof is particularly resistant over time to weather and other conditions, offers substantial chromatic stability (for aesthetic or other purposes) and is environmentally-friendly, as the roofing is made of entirely recyclable material. The tiles removed from demolished buildings can also be easily used again.

The roofing includes tiles and devices for fastening said tiles to a block or beam and batten frame supporting structure.

The tiles can be made of stiff, molded synthetic resin and comprise: along the edges which, when laid, are essentially perpendicular to the maximum slope line, an upper continuous contoured ridge along the upper edge and a lower continuous contoured ridge along the lower edge; and along the edges which, when laid, are essentially parallel to the maximum slope line, contours which are complementary in the partial overlap between said edges of contiguous tiles to make labyrinth seals which will carry off rain water towards the tiles of the row below.

According to this invention, said ridges are step-shaped to engage, when laid, with horizontal continuity, a row of tiles below with the row of tiles above. Furthermore, said anchoring, devices include; a through hole in one of the ridges and a slot in the other ridge to fasten two tiles from contiguous rows that partially overlap along the ridges to an underlying supporting structure with a screw device.

Advantageously, said continuous ridges are square step-shaped, which also allows limited relative sloping by limited relative play.

The screw holes are formed next to the lower edge whose lower ridge overlaps the upper ridge of a tile below presenting two slots. Said slots can be formed in enlargements of the ridge of said upper edge.

That one of the aforesaid complementary labyrinth contours, which is underneath the other when laid, and forms ducts on the upper, i.e. dorsal, surface, can end—downstream—with a stepped recess to facilitate water carry-off onto the tile below.

The roofing can include ridge caps shaped like inverted gutters which can present overlapping profiles to form carry-off duct labyrinths and, along each of the longitudinal edges, a flexible lip suitable for adapting to the slope of the corresponding roof pitch and for being anchored to the tiles on which it rests when laid.

The roofing can include half tiles for completing each horizontal row of adjacent tiles, to be arranged alternately at one end and at the opposite end in contiguous rows of tiles, so that the tiles of one row are staggered with respect to those of the contiguous row; which half tiles can also be produced by cutting a tile.

In a possible configuration, the plate of the tile forms a "bent tile" contour with external and internal arched terminal edges which engage, when laid, with those of the plates of contiguous rows.

Some tiles can be made of clear material, such as polycarbonate or similar, to create skylights simply by fitting the clear tiles in specific areas of the roof.

The invention will be better understood with the following description and accompanying drawing, illustrating a practical, nonrestrictive example of the invention.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

FIGS. 3 and 4 illustrate perspective views of a tile, from above and from below;

FIGS. 5, 6 and 7 illustrate local sections marked V—V, VI—VI and VII—VII in FIG. 2;

FIGS. 8 and 9 illustrate local sections, marked VIII—VIII and IX—IX in FIG. 2;

FIGS. 10 and 11 illustrate local sections marked X—X and XI—XI in FIG. 2;

Figure 19:
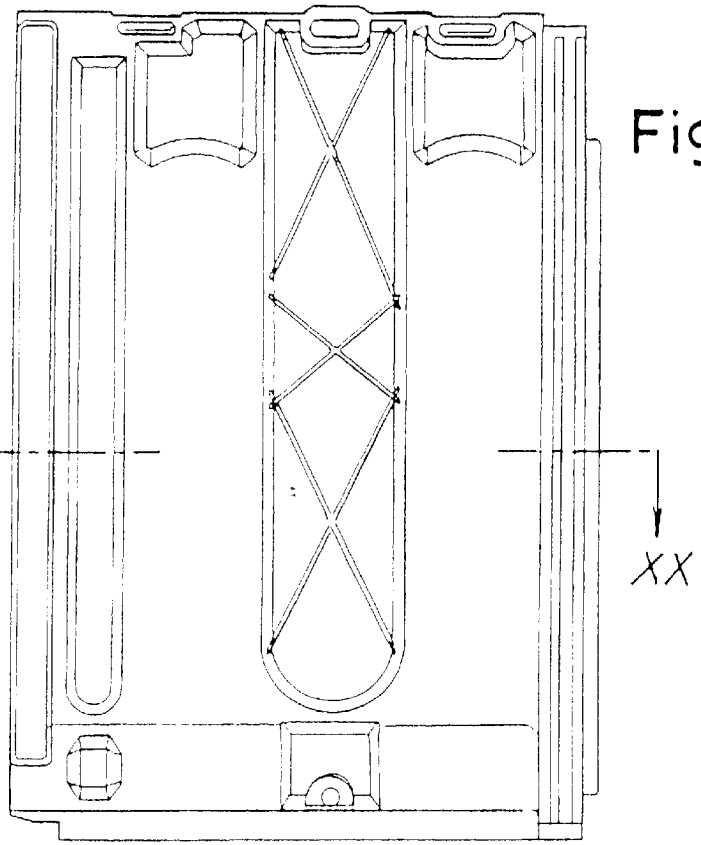
Figure 18:
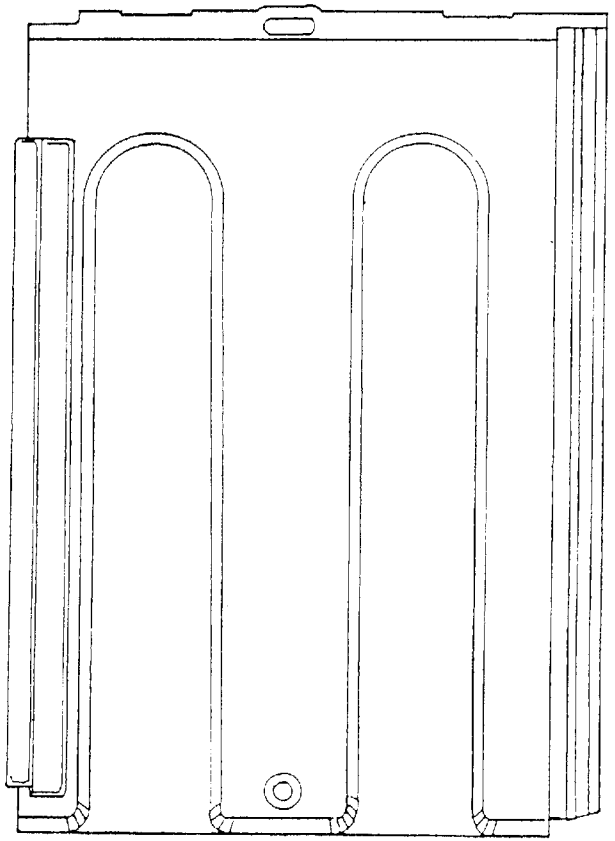
Figure 20:
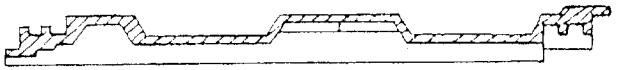
Figure 21:
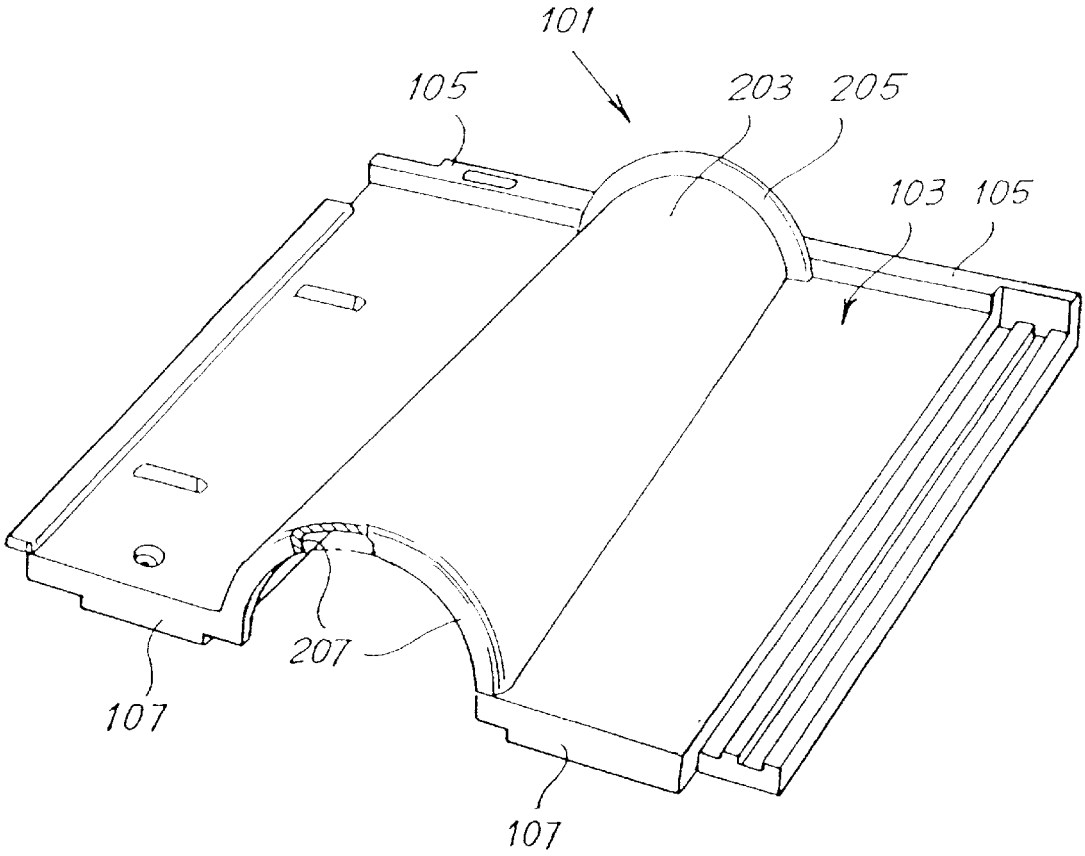

FIGS. 18, 19, and 20 illustrate tiles of reduced dimensions in views from above and from below and in cross section according to line XX—XX in FIG. 19; and FIG. 21 is a perspective view of a modified embodiment of the tile.

DESCRIPTION OF THE PREFERRED EMBODIMENTS

As illustrated in the accompanying drawing, the tile 1 consists of a plate 3, with relatively limited thickness and a substantially rectangular shape, presenting an upper edge 3A and lower edge 3B when laid with the inclination due to the slope of the roof. 3C and 3E, on the other hand, indicate the edges parallel to the maximum slope line. Plate 3 is relatively thin and reinforced by means of a ribbing parallel to edges 3C and 3E, which forms channels 3F on the dorsal, i.e. the external, surface when laid. The channels start at a limited distance from upper edge 3A and drain along lower edge 3B to eliminate rain water onto the dorsal surface of the tiles below, i.e. downstream with respect to the maximum slope and direction of rain water flow shown by arrows f1. A continuous upper step-shaped contoured ridge 5 is formed on the surface of the tile along the upper edge 3A. Ridge 5 can form an approximate right angle. A lower continuous downward ridge 7 is formed along the lower edge 3B and extends towards the lower, or palmar, surface of the tile, with a profile substantially complementary to that of ridge 5. The two ridges 5 and 7 engage and couple as illustrated, in particular, in FIGS. 5, 8, 9, 10 and 11, with limited play to allow, if required, limited angular adaptation between successive tiles along the maximum slope line. This ensures easy coupling between successive tiles along the maximum slope line and also makes it possible to follow any curves in the roofing.

Figure 2:
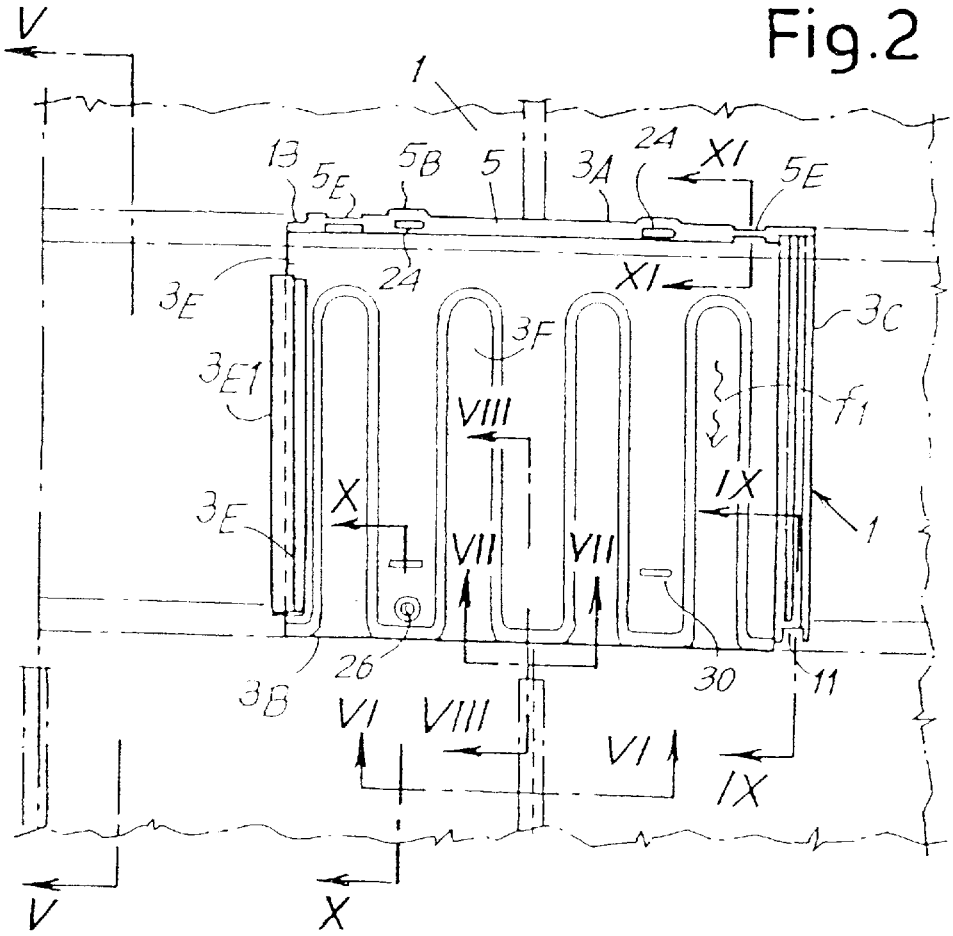
FIG. 2 illustrates a set of tiles, of which only one is in solid lines, to illustrate rows of staggered tiles on a roofing.
Figure 3:
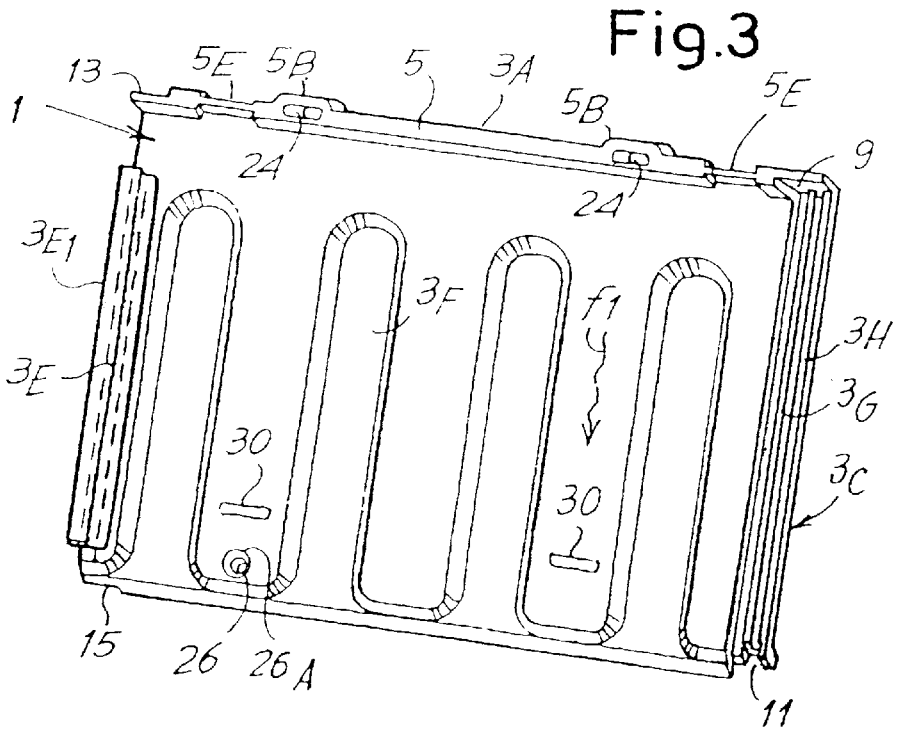
Figure 12:
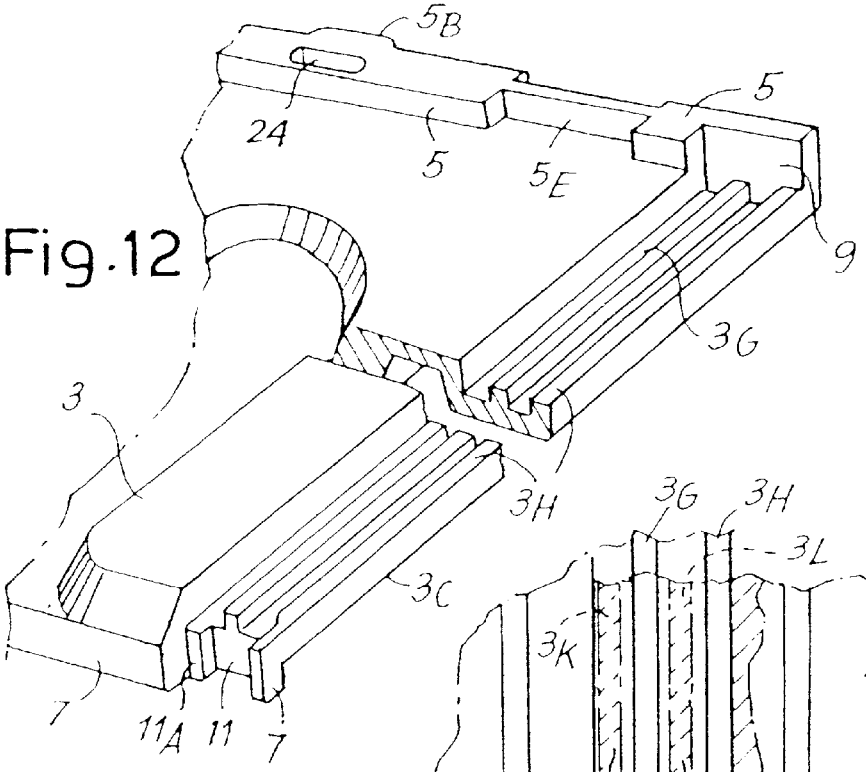
FIG. 12 illustrates a partial perspective view of a tile along the side forming the labyrinth.
Figure 13:
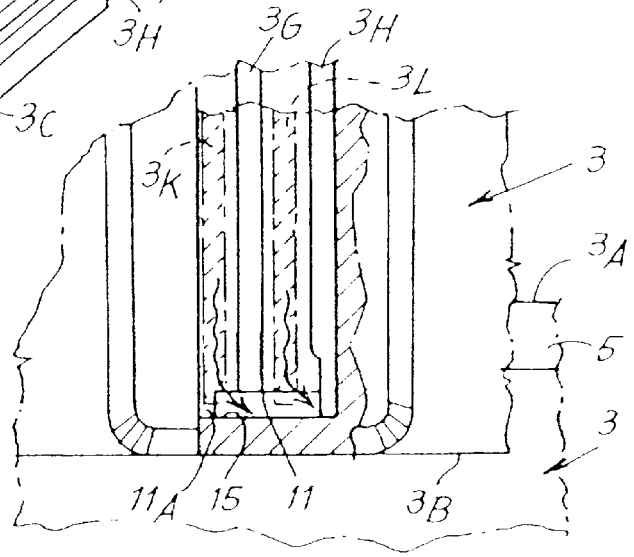
FIG. 13 illustrates a plan view of a portion of FIG. 12 and of a contiguous, partially sectioned tile.

Edges 3C and 3E, which once laid slope with the maximum roof slope, present complementary contours which—in the partial overlapping between said edges 3C and 3E of contiguous tiles of a horizontal row of tiles—form labyrinth seals which will carry off water towards the tiles of the row below. For this purpose, edge 3C of the tile which is designed to remain underneath in the overlapping between contiguous tiles, presents two longitudinal ridges 3G and 3H defining two ducts, while the edge 3E, above in the overlapping between contiguous tiles, presents two longitudinal ridges 3K and 3L which interpose between the two ridges 3G and 3H, forming the aforesaid labyrinth (see, in particular, FIGS. 6 and 7). The edge 3E of each tile may be completed with a limited ridge 3E1 which covers the connection between the two tiles, for nearly the entire connection, with the exception of a small section towards the upper edge 3A and ridge 5. The continuous ridge 5 presents a notch 9 at the corner between edge 3C and edge 3A, which reduces the step profile. A recess 11 is provided in ridge 7 at the corner between edge 3C and edge 3B, where the ducts formed by longitudinal ridges 3G and 3H lead. This step-shaped recess 11 facilitates rain water downflow along the ducts formed by said ridges 3G and 3H. Furthermore, a step 13 is created at edge 3E (see specifically FIGS. 2, 3 and 4); the step is shaped to house the residual part 9 of the contoured ridge 5 where step 9 is created on the contiguous tile. An indent 15, on the other hand, is formed in the convergence between edge 3E and edge 3B to allow edges 3C and 3E of contiguous tiles to overlap and maintain continuity between contoured ridges 7 of the contiguous tile in a row. This ensures that, during assembly, an adequate passage is created between recess 11 and indent 15 for draining water from the ducts formed by ridges 3G and 3H to the tiles on the row below. An angular projection 11A on recess 11 stabilises the position between tiles where recess 15 is arranged (see specifically FIGS. 12 and 13).

Tiles 1 are made of injection molded thermoplastic resin. The resin may be either coloured or clear (e.g. for manufacturing fixed skylights). These materials are totally recoverable and even repeatedly recyclable.

Anchoring of tiles to the roofing support structure S is done along horizontal edge 3A of plate 3 of tile 1.

The support structure S can consist of a block or a beam and rafter structure—with battens, where required—or other equivalent structures for this purpose, on which to arrange and anchor profiles 30. These profiles can consist of wooden laths 18 horizontally anchored to structure S. Said laths 18 can take wood screws or similar.

The tiles 1 present linear ridges 20 and 20A—on the lower face and along a lower reinforcement 5A on ridge 5—which are designed to rest on the horizontal laths 18 (or other supporting structure) so as to maintain an air circulation gap between tiles and laths 18. Along side 3A, the ridge 5 and the respective enlargement 5A present enlargements 5B, where through slots 24, parallel to edge 3A, are formed (also see FIG. 10). A hole 26—with upper enlargement 26A—is formed in each tile 1 next to ridge 7 and to lower edge 3B. When assembled, a large screw 28 can be inserted in hole 26, 26A of one tile and in slot 24 of the tile below to be fastened to lath 18. This fastens the tiles 1 to laths 18. A seal is placed under the head of screw 28 to prevent the infiltration of water.

Ridge 5 along edge 3A of the tile presents two narrower areas 5E for molding reasons.

Special linear ridges 30 can be formed on the upper face of each tile and along the reliefs to provide adequate resistance to prevent the feet of people accessing the roof for inspections, or other purposes, from slipping.

The roofing assembly is started from the eaves tiles which are arranged on the supporting structure and anchored with screws 28 to lath 18 near the eaves. The next row of tiles 1 is then laid over the first row of eaves tiles, engaging the two rows of tiles by coupling ridges 5 of the tiles of the row above with ridges 7 of the tiles of the first row, and so on. A slight slope variation can be attained between the tiles of one row and those of the contiguous row. With a single screw 28 for each tile the entire roofing can be secured. Interventions which may be required in time after assembly—for replacements or other purposes—are possible by removing a very limited number of screws 28. The assembly operation is continued all the way to the ridge.

The tiles of the various successive rows can be staggered with respect to each other. Tiles presenting a horizontal dimension (i.e. distance between an edge corresponding to 3C and an edge corresponding to 3E) smaller than regular tiles can be used alternatively at the ends of successive rows. When tiles are arranged in a staggered fashion with respect to those of adjacent rows, tiles presenting a size equal to half the distance between edges 3C and 3E—as illustrated in FIGS. 18–20—can be used. Alternatively, regular tiles can be cut in half along a middle line between edges 3C and 3E to obtain two "complementary" half tiles. An even roof covering will be produced, including along the maximum slope line at the ends of the roofing, by arranging the half tiles alternately at one end of one row and at the opposite end of a contiguous row.

The same tiles can be manufactured with inert filling material, selected to offer thermal and acoustic insulation. Furthermore, by using laths 18 of suitable height, the space between structure S and the tiles can be used to accommodate thermal and/or acoustic insulation material and/or channels or the like.

Figure 14:
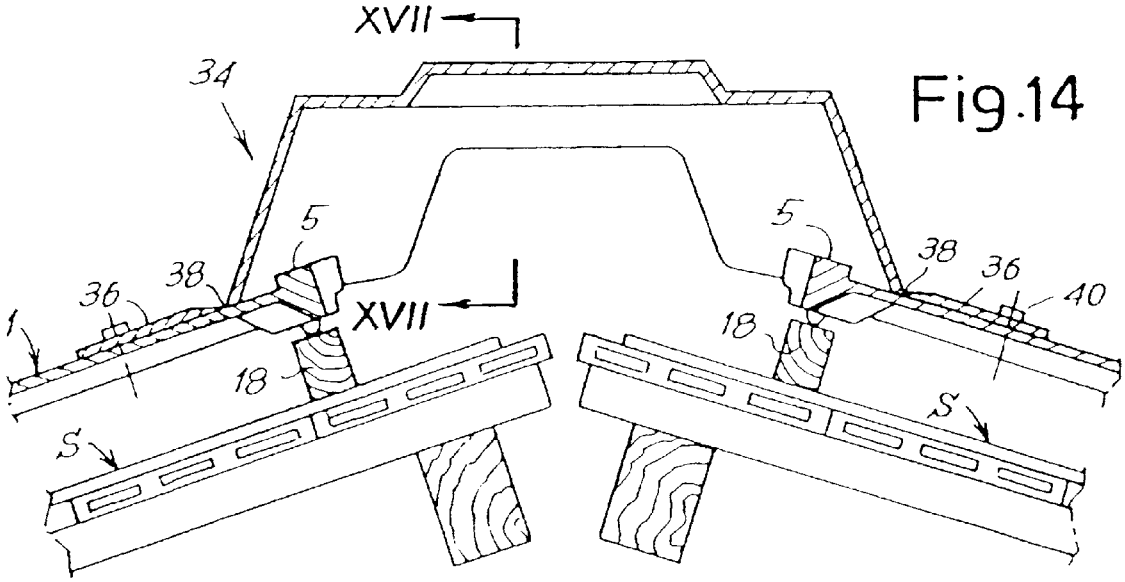
FIGS. 14, 15, 16 and 17 illustrate elements for forming a ridge between two pitches, in views and sections marked XIV—XIV in FIG. 1, XV—XV in FIG. 16, XVI—XVI and XVII—XVII in FIG. 14, on various scales.
Figure 15:
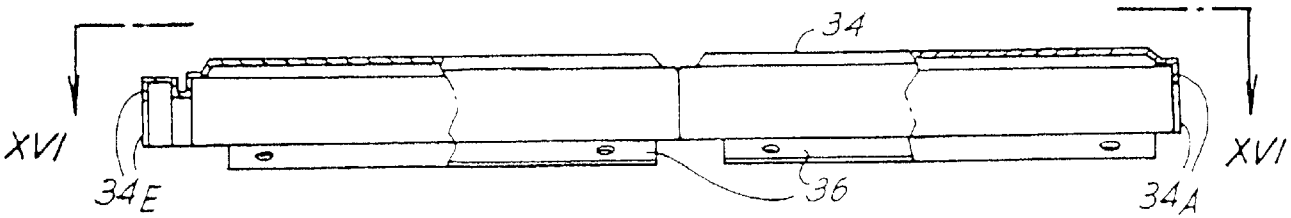
Figure 16:
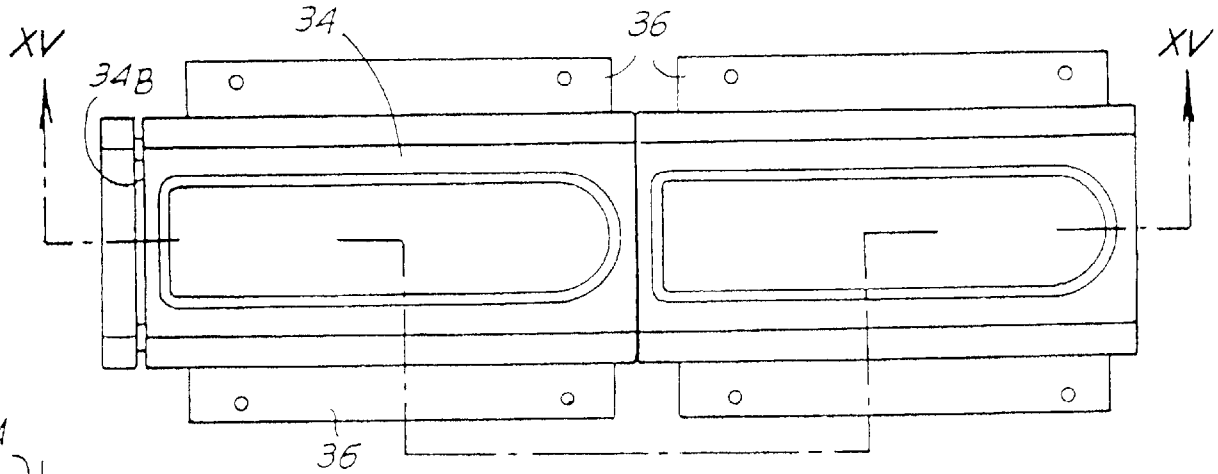
Figure 17:
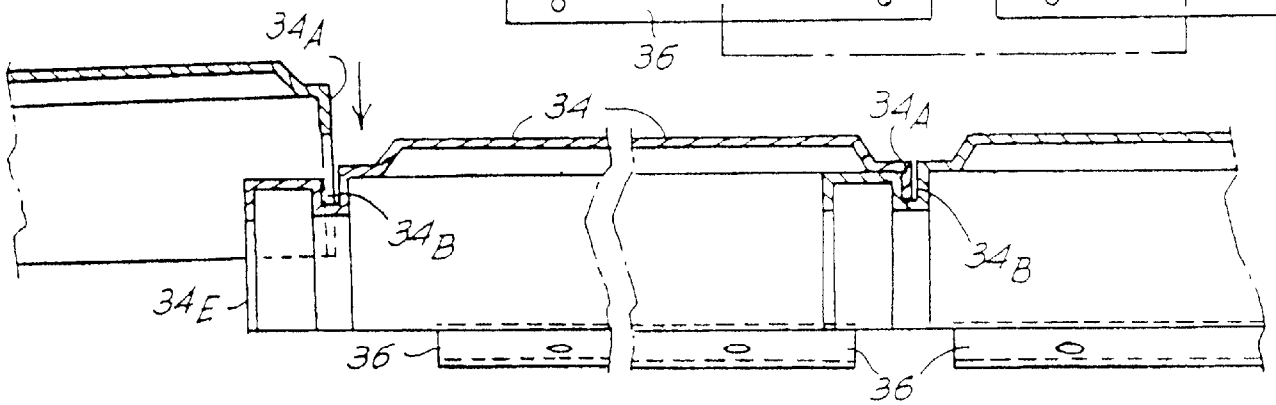

Ridge caps, generically indicated as 34 (see FIGS. 14–17), can be used to complete the roof along a ridge, specifically between opposite pitches presenting equal or different slopes. These ridge caps form an inverted "gutter" once fitted and are mutually engaged by the partially overlapping ends, due to the presence of arched edges 34A which are inserted into arched ducts 34B of the contiguous ridge cap, as clearly shown in the drawing. Ridge caps 34 are suitable for covering the tiles of the last upper row of each pitch by containing the upper ridges 5 of the tiles of said last rows, as shown by the section view in FIG. 14. The ridge caps 34 are anchored by the longitudinal corners of caps 34 extending for at least the main portion of their development to form lips 36, which are flexible, i.e. can be slanted variably by the reduction in thickness of fitting 38 between the sides of the ridge caps 34 and the lips 36. As a result, the lips 36 can be adapted to practically any maximum slope line of roofing pitches and can be fastened to the tiles by means of rivets, screws, nailing or other. These lips 36 ensure the anchoring of ridge caps 34 without the risk of infiltration of rain water. Tightness can be ensured by the adherence of lips 36 to the tile, by the virtually waterproof nature of rivets 40, or equivalent fasteners, and due to the fact that the ridges 5 of the tiles are contained inside the ridge caps. At the end, or at both ends, of the roof ridge, special ridge caps with ends such as 34E, finished with a partition, instead of a simple side, form a duct such as 34B. A similar side can be used also for all the other ridge caps. Ridge caps can be sawed like tiles.

Figure 1:
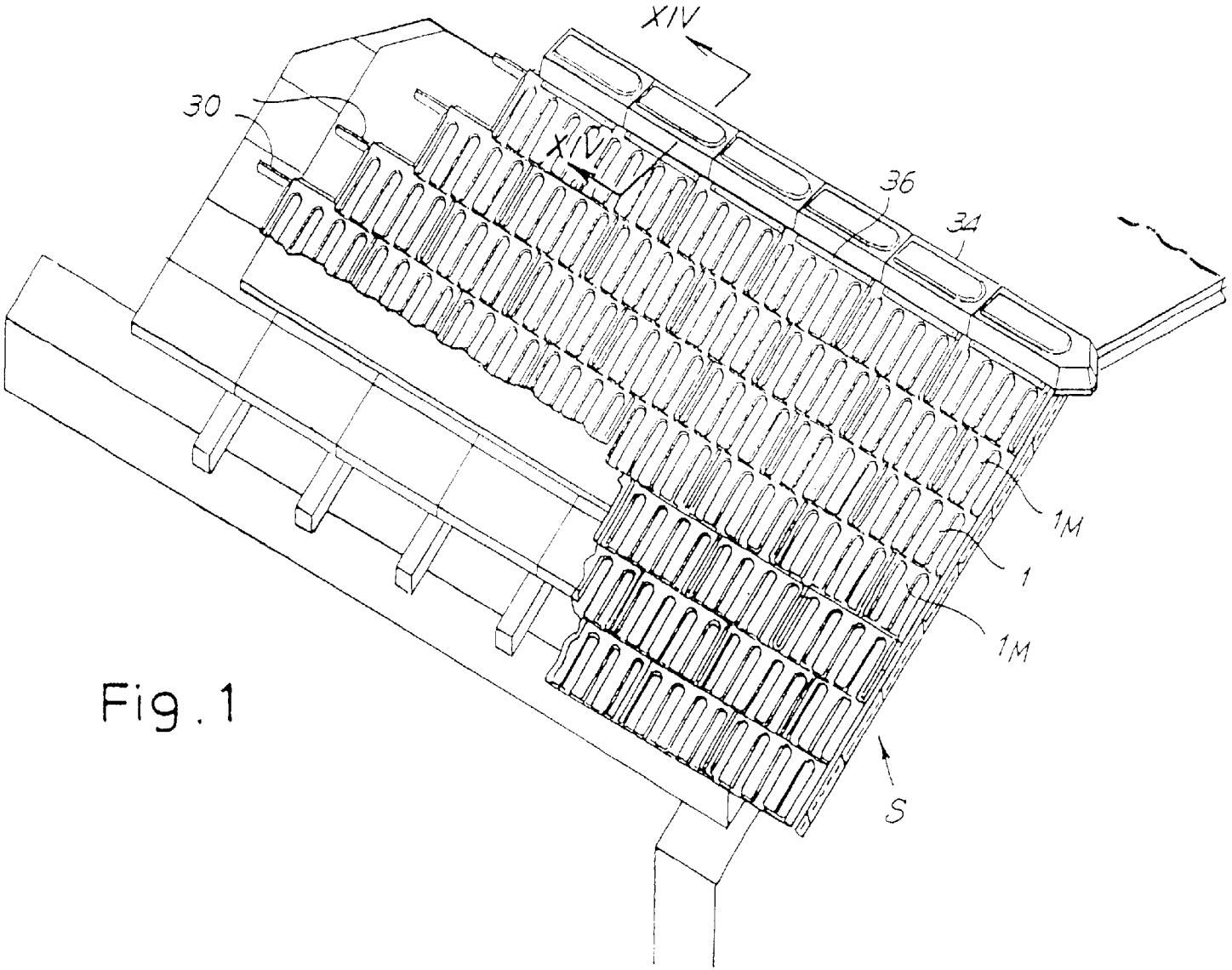
FIG. 1 illustrates a perspective view of a roofing, with parts removed.

FIG. 21 illustrates a modified tile for making roofs similar to those traditionally made with flat plain tiles and inverted-duct arched bent tiles. Part 101, unique in this case, is similar to the tile described above but plate 103 of said tile is modified centrally to form "bent" contour 203, with arched terminal edge 205 projected outwards at the end corresponding to ridge 105, and arched terminal edge 207 projected inwards, at the end which corresponds to ridge 107. When laid, edge 205 of the part 101 below is contained by edge 207 of the part 101 above. This forms "bent tile" contour lines 203 along the maximum slope lines. The contiguous parts 101 of successive rows are, in this configuration, aligned, rather than, as in the successive rows of tiles of the configuration illustrated in FIG. 1, staggered. The bent tiles 101 can similarly be laid with a limited curvature of the maximum slope line.

It will be understood that the drawing only illustrates an example provided for practical demonstration purposes of this invention only, as its forms and configurations can be modified without departing from the scope of the concept on which this invention is based. Any reference numbers included in the accompanying claims have the purpose of facilitating reading the claims with reference to the description and the drawing and. does not limit the scope of protection represented by the claims.

It is worth noting that the tile material can be coloured as required for aesthetic purposes. Clear material—such as polycarbonate—can be used for roofing which allows natural lighting of the interior.

What is claimed is:

1. Roofing for buildings including tiles and devices for anchoring said tiles to a supporting structure, said tiles including, along an upper and lower edge which, when laid, are substantially perpendicular to a maximum slope line, an upper continuous contoured ridge along the upper edge and a lower continuous contoured ridge along the lower edge, and along a first and a second edge which, when laid, are substantially parallel to the maximum slope line, labyrinth contours which are complementary in a partial overlap between said first and second edges of contiguous tiles to make labyrinth seals which will carry off rain water towards the tiles of the row below, said ridges being step-shaped to engage, when laid, with horizontal continuity, a row of said tiles below to the row of said tiles above, wherein anchoring devices include on the tiles a through hole along the lower ridge and a slot along the upper ridge to fasten two said tiles from contiguous rows that partially overlap along the ridges, to said supporting structure, said anchoring device being accessible and said first and second edges overlapping each other;

ridge caps shaped like inverted gutters, said ridge caps having longitudinal edges with overlapping profiles to form carry-off duct labyrinths, said ride caps also including a flexible lip suitable for adapting to the slope of the roof and for being anchored to the tiles on which it rests when laid.

2. Roofing according to claim 1, wherein the holes are formed net to the lower edge in which the lower ridge overlaps the upper ridge of a said tile below, provided with said slots.

3. Roofing according to claim 1, wherein the slots are formed in corresponding enlargements of the upper ridges on the upper edge.

4. Roofing according to claim 1, wherein one of said complementary labyrinth contours ends downstream with a stepped recess to facilitate water carry-off.

5. Roofing according to claim 1, wherein said tiles are manufactured from polycarbonate.

6. Roofing according to claim 1, wherein said roofing includes a plurality of said tiles in a plurality of rows, said roofing also includes half tiles arranged in one of said rows and staggering said tiles of said one row with respect to said tiles of an adjacent said row;

said half tiles can also be produced by cutting one of said tiles.

7. Roofing according to claim 1, wherein a plate of the tile forms a bent tile contour with an external and an internal arched terminal edges which engage, when laid, with those of the platens of contiguous rows.

8. Roofing according to claim 1, wherein some said tiles are manufactured from a clear material.

9. Roofing according to claim 1, wherein the tiles contain linear ridges on the lower face and along a lower reinforcement on the upper ridge to rest on the supporting structure.

10. Roofing according to claim 1, wherein said tiles are made of stiff, molded, possibly recyclable synthetic resin.

11. The roofing according to claim 2, wherein the slots are formed in corresponding enlargements of the upper ridge on the upper edge.

12. A roofing for buildings including tiles and devices for anchoring said tiles to a supporting structure, said tiles including, along an upper and lower edge which, when laid, are substantially perpendicular to a maximum slope line, an upper continuous contoured ridge along the upper edge and a lower continuous contoured ridge along the lower edge, and along a first and a second edge which, when laid, are substantially parallel to the maximum slope line, labyrinth contours which are complementary in a partial overlap between said first and second edges of contiguous tiles to make labyrinth seals which will carry off rain water towards the tiles of the row below, said ridges being step-shaped to engage, when laid, with horizontal continuity, a row of said tiles below to the row of said tiles above, wherein anchoring devices include on the tiles a through hole along the lower ridge and a slot along the upper ridge to fasten two said tiles from contiguous rows that partially overlap along the ridges, to said supporting structure, said anchoring device being accessible and said first and second edges overlapping each other;

said tiles being comprised of stiff, molded, recyclable synthetic resin, said tiles having ridge caps shaped as inverted gutters with overlapping profiles and along each of a first and a second longitudinal edge contains a flexible lip, wherein the plate of the tile forms a bent tile contour having an external and an internal arched terminal edges, and devices for anchoring said tiles to supporting structure, said tiles including along an upper and a lower edge which, when laid, are substantially perpendicular to a maximum slope line, an upper continuous contoured ridge along the upper edge and a lower continuous contoured ridge along the lower edge, and along the first and second edges which, when laid, are substantially parallel to the maximum slope line, contours which are complementary in the partial overlap between said first and second edges of contiguous said tiles to make labyrinth seals which will carry rain water towards the tiles of the row below, wherein one of said contours forms ducts on the dorsal surface ends downstream with a stepped recess to facilitate water carry-off onto the tile below; said ridges being step-shaped to engage, when laid, with horizontal continuity, a row of the tiles below to the row of the tiles above, wherein said anchoring devices include on the tiles a through hole formed next to the lower edge along the lower ridge which overlaps the upper ridge of a tile below and a slot, formed in corresponding enlargements along the upper ridge to fasten two of said tiles from contiguous rows that partially overlap along the ridges, to said supporting structure, wherein said tiles have linear ridges to rest on the supporting structure; said anchoring device being accessible and said edges overlapping each other.

13. Roofing according to claim 12, wherein said resin is polycarbonate.

* * * * *